US007093768B2

(12) United States Patent
Reichel et al.

(10) Patent No.: US 7,093,768 B2
(45) Date of Patent: Aug. 22, 2006

(54) RIGID TRACK

(75) Inventors: Dieter Reichel, Neumarkt (DE); Stefan Bögl, Sengenthal (DE); Erich Lindner, Auerbach-Nasnitz (DE)

(73) Assignee: Max Bogl Bauuntemehmung GmbH & Co., Neumarkt (DE)

( * ) Notice: Subject to any disclaimer, the term of this patent is extended or adjusted under 35 U.S.C. 154(b) by 27 days.

(21) Appl. No.: 10/486,214

(22) PCT Filed: Jul. 9, 2002

(86) PCT No.: PCT/EP02/07601

§ 371 (c)(1),
(2), (4) Date: Feb. 6, 2004

(87) PCT Pub. No.: WO03/014472

PCT Pub. Date: Feb. 20, 2003

(65) Prior Publication Data

US 2005/0017085 A1 Jan. 27, 2005

(30) Foreign Application Priority Data

Aug. 10, 2001 (DE) ..... 101 38 309
Aug. 13, 2001 (DE) ..... 101 38 624

(51) Int. Cl.
*E01B 5/18* (2006.01)

(52) U.S. Cl. ..... 238/17; 238/2; 238/3

(58) Field of Classification Search ..... 104/2, 104/258, 259, 260; 238/2, 3, 7, 10 R, 17, 238/20, 25, 258, 259, 260, 265, 264, 310
See application file for complete search history.

(56) References Cited

U.S. PATENT DOCUMENTS

| | | | | |
|---|---|---|---|---|
| 3,311,304 | A * | 3/1967 | Becker et al. | 238/17 |
| 5,285,964 | A * | 2/1994 | Vanotti | 238/7 |
| 5,933,233 | A | 8/1999 | Gunther | |
| 6,216,958 | B1 | 4/2001 | Unbehaun | |

FOREIGN PATENT DOCUMENTS

| | | | |
|---|---|---|---|
| DE | 19931048 | | 2/2001 |
| DE | 19941060 | | 3/2001 |
| DE | 10004626 | | 8/2001 |
| DE | 10032437 | | 8/2001 |
| DE | 19850617 | | 8/2001 |
| DE | 10032437 | A1 * | 1/2002 |
| DE | 10004626 | C2 * | 11/2003 |
| EP | 0516612 | B1 | 12/1992 |
| EP | 0546380 | B1 | 6/1993 |
| EP | 1231323 | A2 | 8/2002 |
| HU | 22191781 | | 2/2003 |

OTHER PUBLICATIONS

German Patent Office Search Report, Jul. 10, 2002.
Hugarian Patent Office Search Report, Jun. 16, 2004.
European Patent Office International Search Report, Jul. 9, 2002.

* cited by examiner

*Primary Examiner*—Frantz F. Jules
(74) *Attorney, Agent, or Firm*—Dority & Manning

(57) ABSTRACT

A rigid track consisting of concrete, in particular pre-cast components, comprising a slab with traversing fixing elements, or a plurality of fixing elements arranged thereon, of rails for track-borne vehicles. The inventive rigid track is characterized by a pre-cast concrete component constituting a protuberance that is positioned on the slab, parallel to at least one rail and located on at least one side of the rail. The protuberance acts as a guard and a guide for the vehicle during derailment.

23 Claims, 2 Drawing Sheets

RIGID TRACK

BACKGROUND OF THE INVENTION

The present invention concerns a rigid track bed of concrete, especially made of precast concrete modules, with a slab and continuous fastenings or a multiplicity of fastenings for rails mounted thereon for track guided vehicles.

DE 198 50 617 A1 discloses cross ties for a rigid run of track. Individual ties are aligned in rows, thus forming a base substrate for rails which are subsequently laid thereon. The individual ties are separated from each other at a predetermined distance and are predominately not rigidly tied together. In order to enable the best possible disturbance-free travel of a rolling wheel of a track guided vehicle, the proposal is to place bearing elements upon the rails, which can be integrated into tie and concrete structure below. The concrete understructure is further molded with retaining grooves, wherein a derailed wheel can run. The concrete ties possess, in turn, a specified spacing from one another, so that a rail-borne wheel rolls from one tie to another. The ties and the track fastenings, as well as the bearing elements, are all subject to damage thereby.

DE 199 31 048 A1 teaches the placement of a rail for track guided vehicles on a rail bearing slab. On the slab are provided absorbent pads, which are affixed to the rail bearing slab by bolts. If derailment protection is required, then the absorption pads serve immediately to the affixing of the surface protection elements, on which the derailed wheel can roll. The absorbent pads serve, in such a case, as a noise control and as a fastening element for derailment safety equipment.

The positional arrangement of the derailment protection rails along the track has been made known by DE 44 38 397 A1, or by DE 199 41 060 A1. In a similar manner to DE 199 31 048 A1, a derailment protection rail made of iron is mounted along the track, in order, that in case of a derailment of a vehicle, the derailed wheel can be safely captured.

SUMMARY OF THE INVENTION

A principal purpose of the present invention is to create a derailment protection, which safely guides a derailed wheel and thereby, to the greatest possible extent, the purpose includes avoidance of damage to the concrete slab of a rigid track bed. Additional advantages of the invention will be set forth in part in the following description, or may be obvious from the description; or may be learned through practice of the invention.

This purpose is achieved by a rigid track bed of concrete, in particular, of precast concrete components, with a slab and a continuous or a multiplicity of fastenings for rails to accommodate track guided vehicles. On the slab parallel to at least one side of at least one rail, a curb is placed as a precast concrete component for the protection of vehicle and for guidance during a derailment of the vehicle.

A rigid track bed is made of concrete, especially of precast concrete components, and possesses a slab with fastenings mounted thereon to mount rails for track guided vehicles. Normally the slabs are about 6 meters long, whereby rail fastening units must be placed, separated from one another at distances of about 60 cm. On each slab, then, a multiplicity of rail fastenings are provided. In accord with the invention, to be found on the slab, and parallel to the rail, is an upward directed, precast, curb. This curb serves for the protection of the slab, the rail and, in case of derailment, also the vehicle. The prefabricated concrete part so acts, that in the intervening space between the rail and itself, a derailed wheel of a track guided vehicle is captured and the vehicle or vehicles can be brought to a stillstand in a gradual manner. The curb, which simultaneously runs along beside the rail, exhibits no particularly large opening between its sections, in which the vehicle, i.e. the derailed wheel can be abruptly prevented from rolling to its stop. By means of the evenly guided run of the wheel, in this way damage of the rigid track bed slab and the curb is substantially avoided. Beyond this, the track guided vehicle is thereby prevented from leaving the rigid track bed, whereupon, under certain circumstances, an entire vehicle can overturn. Thereby, since the curb is designed of precast concrete, the curb is granted sufficient structural strength to retain the vehicle. The force load for such capture can reach some 10 metric tons per meter, which is resisted by a precast concrete part made in accord with modern technology.

Advantageously, the rail fastenings are placed at support points, especially on upward projections of the underlying slab of the rigid track bed. In this regard, there are specified fastening locations created for the rails, so that the rails can be laid in a very exact alignment. The bottom of the space between the rail and the longitudinal curb, in this invented design, can be raised somewhat higher, so that along this path, an even running height for the derailed wheel is created. By this elevation, an abrupt drop of a wheel from one supporting tie and a lifting to a next tie is avoided. In addition to this advantage, an appropriate design of rail fastenings position avoids damage to the fastenings under a rolling derailed wheel. Since the curb is of precast design, the casting can be easily made to include this protective feature.

Particularly advantageous, since the manufacturing costs thereof are low, is to integrate the raised curb into the slab. In this manner, with only one manufacturing step, both the slab and the curb can be made for protection during derailment. No further field mounting labor is necessary, and besides this, the structural strength of the curb is increased by this action, since a firm connection to the massive slab has been created. Derailment protection need not be made in the form of a separate, exchangeable component, since damage to curb and the rigid track bed, when made in the invented design for derailment protection, is only to be feared in very few cases. The integrated manufacture of the curb and the slab is thus advantageous.

It is particularly advantageous, if the curb is placed on that side of the rail proximal to the centerline of the track. The derailed wheel, which is diverted toward the center of the track, is then controlled. Additionally, it is obvious, that an additional curb could be provided on the outside of the rail, so that derailed wheels on both sides of the vehicle could travel securely in a guided path between the rails and the curbs.

Particularly advantageous and of an inventive nature is a situation wherein the continuity of the curb is intermittently provided with slots running transverse to the longitudinal axis of the slab. These slots can serve for the runoff of rain or melt water which collects on the slab.

It is a possibility, that the slot can extend itself through the curb to a point within the slab, then, by this means, stress points of fissures are engendered within the slab. Inevitable cracks can branch out from such slots. However, giving consideration to condition of the slab, such cracking can be controlled. Accordingly, both the fissuring of the curb and of the slab can be specifically regulated. The slotted recesses are so formed, that the over-rolling of the derailed wheel is not particularly disturbed and thus the curb is not damaged.

It is of particular advantage, if the slab itself exhibits additional fissure blocking slots, particularly when the slots of the curb find themselves proximal to the fissure protection areas. In this way, a positive control on the general fissure growth is created. An uncontrolled continuance of branching fissures is reliably avoided by the presence of these slots.

It has proven itself as particularly advantageous, when the shape of the curb is such, that the upper edge of the curb is above the top surface of the rail, by perhaps about 20 mm. In this way, a derailed wheel, which, because of the effective forces of the derailment hops along off the rail, is very reliably arrested by the curb. The derailed wheel is thus forced to roll between the rail and the curb until it is safely brought to a stillstand.

In order to maintain a sufficient spacing between the rail and the sidewall of the curb for the derailed wheel of the track guided vehicle, it is advantageous if the space has a breadth of about 180 mm. Using this dimension, a customary running wheel of a track guided vehicle can be reliably confined, with no fear that the curb or the rail would be damaged, or that the wheel jumps out of the separating space. Obviously, the effective separation can be otherwise dimensioned, if the track guided vehicle possesses wheels, which obviously are wider or narrower than customary. In any case, it is important, that the intervening distance is dimensioned to be sufficiently wide to accommodate the dimensions of a derailed wheel.

It is of particular advantage if the curb is made of high strength concrete. With such strength available, the forces to be expected by a derailment, which work against the derailment safety structures, are containable by the concrete curb, without the expectation that the curb itself will be destroyed and that the vehicle, under certain circumstances, can divert itself from the rigid track bed. With high strength concrete, the curb will exhibit such a structural strength, that the generated derailment forces are contained.

Where an integrated curb is in use, it is advantageous if the curb is further consolidated with the slab by continuous, steel reinforcement rodding. In derailment incident, this supplementary strengthening will prevent the curb from being torn away from the rigid track bed.

Another method of holding to a high structural strength for the concrete curb, is the use of fiber reinforced concrete to enhance the derailment protection of the curb.

If an especially high strength concrete is necessary for derailment protection, then it is also possible, that metal structural members can be worked into the curb. Particularly, with an angle bar embedded in the concrete, the edges of the curb are protected. With this supplementary measure, an especially better derailment protection is brought about, even though, for normal usage, a concrete curb is entirely sufficient.

If curbs with metal structural members are employed, then it is advantageous, if the continuity of the metal structural member is interrupted in proximity to the described slots. In such a case, assurance is given, that the inherent fissuring of the slab of the rigid track bed cannot bridge over and is thus made inactive.

Alternatively, provisions can be made, for metal structural members, particularly rods, to be installed so that they can "prestress" the concrete body, whether slab or curb. If this is done, it becomes possible, that the slab of the rigid track bed can endure load fissuring, without the possibility that bifurcating cracking would extend itself to other than foreseen locations.

Advantageously, the curbs are so designed, that the fastenings for the rail are protected from damage. In this matter, it is advantageous, if the bottom of the intervening space between the curb and the rail, is of such a height, that the wheel rolls therein without contacting the rail fastenings. Such a solution is very easy to realize with premixed concrete curbs.

Further advantages of the present invention are described in the following embodiments in greater detail.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of the embodiment can be used with another embodiment to yield still a further embodiment. It is intended that the present invention cover such modifications and variations.

Figure 1:
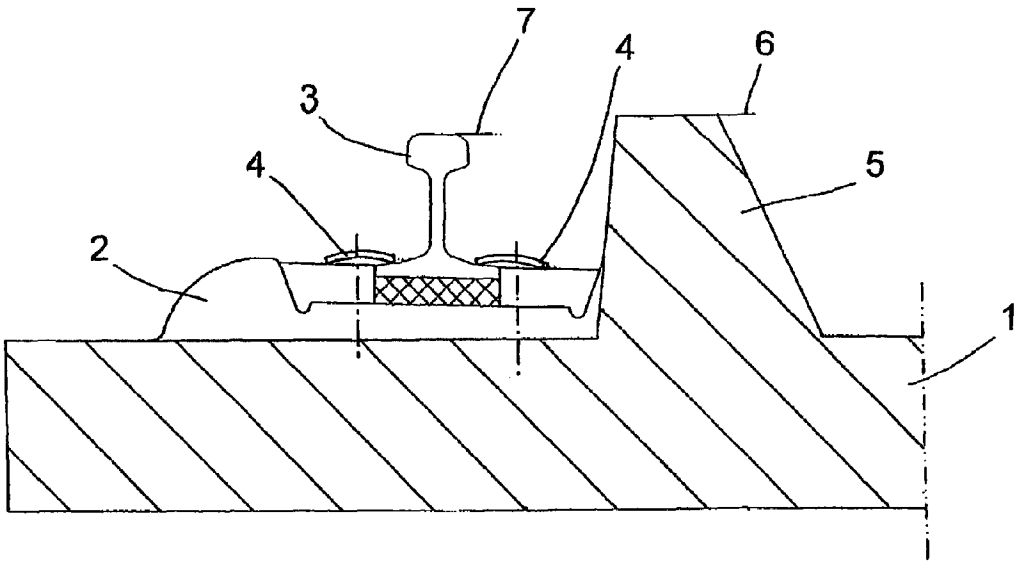
FIG. 1 shows a cross-section through a slab according to the invention.

In FIG. 1 is shown a cross-section through a slab 1 of a rigid track bed in the area of a rail 3. The slab 1 consists of a concrete precast section and carries on its surface a multiplicity of the elevated support points 2, upon which the rail 3 and its rail fastenings 4 are affixed. This arrangement is entirely suitable for the use of conventional rail fastenings 4. The fastening may comprise clamps or bolts, which fasten the foot of the rail to the substrate.

On the slab 1 is placed a curb 5. The curb 5 is best integrated with the slab 1, and thus presents, along with the slab 1, a single precast concrete component. The curb 5 is made of high strength concrete or may be of fiber reinforced concrete, in order that the applied load in the case of derailment of a track guided vehicle may be contained without additional measures and the derailed wheel may continue a controlled rolling in an intervening space between rail 3 and curb 5. The curb 5 in the depicted embodiment is placed toward the centerline of the tracks. The second (not shown) rail of the track can likewise be guarded by a second curb 5, again proximal to the track centerline. By this means, the motion of a derailment of the vehicle is reliably limited in both directions. Such structuring, however, is not required in every case.

The curb 5 possesses an upper edge 6. which is higher than an upper edge 7 of a rail 3. This difference in elevation provides assurance, that during a derailment, under certain circumstances a hopping, derailed wheel remains safely confined in the intervening space between the rail 3 and the curb 5. As a difference in the elevations, a dimension of some 20 mm has shown itself to be sufficient. The width of the intervening space between the head of the rail 3 and the inner wall of the curb 5, at least for common wheels of track guided vehicles, is measured at 180 mm, which is considered sufficient. In this case, the wheel is securely caught therein with directionally controlled roll, and remains so until it is brought to a stillstand.

Figure 2:
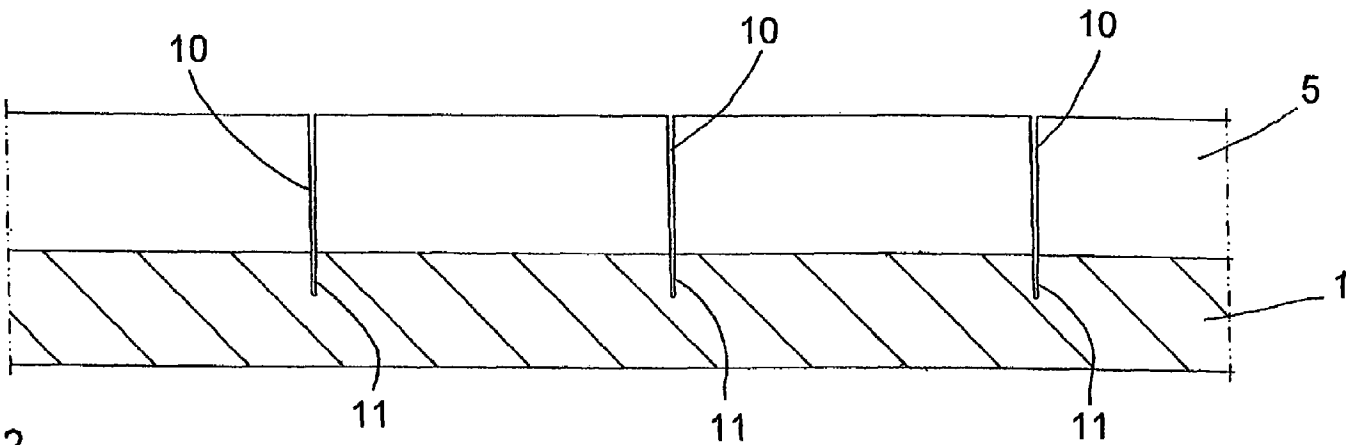
FIG. 2 shows a profile view of a slab.

FIG. 2 shows a longitudinal side view of the slab 1, with a profile of the curb 5. Illustrated here, the curb 5 is divided by slots 10 in regular succession, approximately 650 mm apart. The slots 10 extend into the slab 1 below and transform themselves into safety slots blocking the random growth of fissures. Inevitable cracks can develop proximal to the safety slots, when the precast slab 1 is laid in place or during its curing period. Therefore, the slot 10 is placed proximal to a fissure-blocking position 11 of the slab 1. Furthermore, a sinking of the substrate soil can lead to associated fissures, which extend themselves to the safety slots and are there brought under control. Moreover, the safety slots serve for the runoff of rain or melt water which would collect on the slab. The rain or melt water, which collects on the slab, or between the slots can drain from the outer side openings of the slab.

Figure 3:
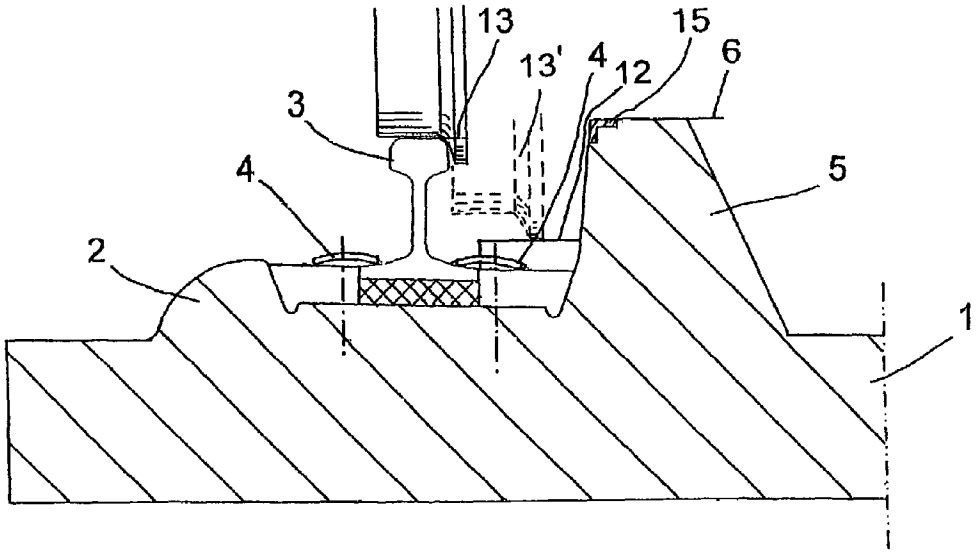
FIG. 3 shows an alternative embodiment in cross-sections.

FIG. 3 provides an alternative embodiment of a curb 5. The curb 5 here possesses a raised bottom 12, which runs from one set of rail fastenings 4 to the next set of rail fastenings 4 in the longitudinal direction of the rails 3. A wheel 13, which normally rolls on the rail 3, in an uncontrolled derailment, would be captured in the intervening space between the rail 3 and the curb 5. Accordingly, the derailed wheel 13' rolls on the bottom 12 of the curb 5. In order to avoid damage to the rail fastenings 4, the bottom 12 is so elevated in relation to the rail fastenings 4, that the rail fastenings 4 can be rolled over by the derailed wheel 13' without damage.

The curb 5 possesses in this exemplary embodiment, a metal structural member 15 on the upper edge 6, proximal to the rail 3. This metal structural member 15 serves as a protector of the edge 6, in order to avoid a breaking off of the upper edge 6 of the curb 5 in a case of an abrupt impact of the wheel 13 thereagainst during a derailment. The curb 5 itself is the actual safety element against derailment damage.

Figure 4:
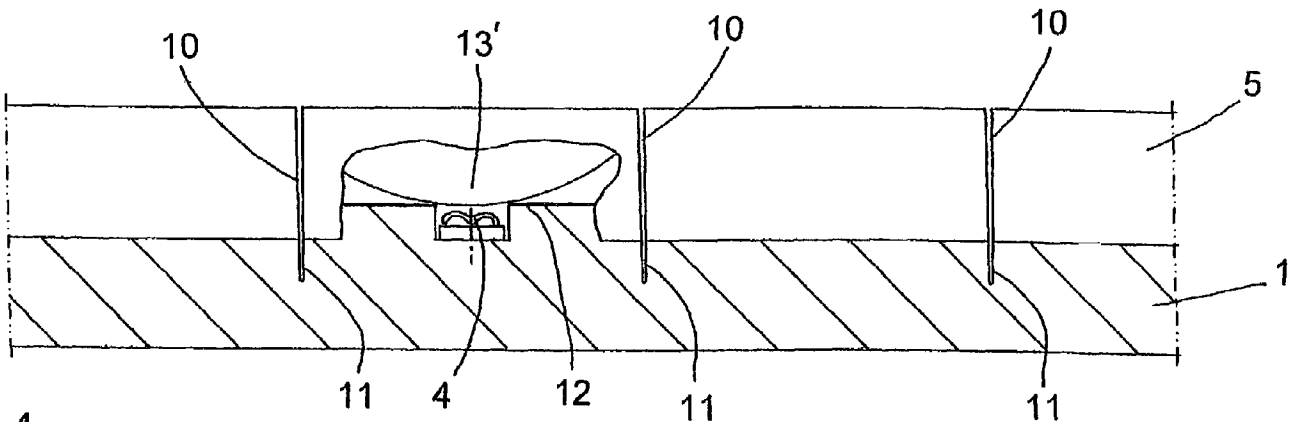
FIG. 4 shows a profile view of the slab of FIG. 3.

FIG. 4 shows a longitudinal side view of the subject of FIG. 3. From this illustration may be inferred, that the bottom 12 of the curb 5 is placed at such an elevation, that the derailed wheel 13' rolls directly over the rail fastenings 4, without touching these. Any damage to the rail fastening 4, and thereby also damage to the rail 3 is thus reliably avoided. The rail fastenings 4 are respectively located in a depression in the bottom 12 and thus do not come into contact with a derailed wheel 13'. This is because the wheel 13' rolls from the first partial level of the bottom 12 onto the second partial level of the bottom 12 without dropping so low, that it comes into contact with the fastening apparatus 4.

The present invention is not limited to the described embodiment examples. Other formulations of the curb 5 and the rail fastenings 4 as well as the rail support points can be made at any time. For instance, the curb 5 can be designed exactly in the manner of a second curb (not shown) running parallel at the other side of the slab 1. This even allows a platform, which could be used for salvage and rescue crews. Beyond this, an additional parallel running curb can be laid on outside of each rail 3. In this way, an additional derailment safety measure is created. The cross-sectional shape of the curb 5 obviously, can be altered in molding from the shape here illustrated. Moreover, the curb 5 can be bolted to the slab 1, whereby this would involve a somewhat less stable design than the above described integrated precast construction of the same.

In regard to the fastening of the rails, it is possible that one continuous fastening arrangement of the rail can be made on the slab, instead of the fastening the rail at a multitude of positions thereon. A fastening structural member clamps the rail to a provided holding means on the slab.

It will be appreciated by those skilled in the art that various modifications and variations can be made in the present invention without departing from the scope of the invention. It is intended that the present invention include such modifications and variations as come within the scope of the appended claims and their equivalents.

The invention claimed is:

1. A rigid track bed for a track guided vehicle, the rigid track comprising:

at least one precast concrete slab;

rails disposed on said precast concrete slab, said rails configured to accommodate the track guided vehicle;

at least one rail fastening disposed on said precast concrete slab, said fastening securing said rails to said precast concrete slab;

a curb operably carried on said precast concrete slab and aligned parallel to at least one side of at least one of said rails, said curb configured to provide protection and guidance to the track guided vehicle upon derailment of the track guided vehicle; and wherein said curb defines at least one slot extending transverse to a longitudinal axis of said precast concrete slab.

2. A rigid track as in claim 1, wherein said curb acts as a uniform guide element for the derailed wheel of the track guided vehicle.

3. A rigid track as in claim 1, wherein said at least one rail fastening is at least one of a continuous fastening or a multiplicity of fastenings.

4. A rigid track as in claim 3, wherein said at least one rail fastening is installed at elevated support points on said precast concrete slab.

5. A rigid track as in claim 1, wherein said curb is integral to said precast concrete slab.

6. A rigid track as in claim 1, wherein said curb is located on said precast concrete slab on a side of said at least one of said rails which is proximal to a centerline of the rigid track.

7. A rigid track as in claim 1, wherein said at least one slot extends into said precast concrete slab.

8. A rigid track as in claim 7, wherein said at least one slot is defined proximal to a fissure-blocking position within said precast concrete slab.

9. A rigid track as in claim 1, wherein a longitudinal side of said curb proximal to said at least one of said rails has a separating distance from a top of said rail that corresponds to space that allows acceptance of a derailed wheel of the track guided vehicle.

10. A rigid track as in claim 9, wherein said separating distance is about 180 mm.

11. A rigid track as in claim 1, wherein said curb comprises a high strength concrete.

12. A rigid track as in claim 1, wherein said curb comprises a fiber-reinforced concrete.

13. A rigid track as in claim 1, wherein at least one of said slab or said curb includes metallic reinforcement.

14. A rigid track as in claim 13, wherein said curb includes a structural metal member.

15. A rigid track as in claim 14, wherein said structural metal member comprises an angle bar disposed along a longitudinal side of said curb proximal to said at least one of said rails.

16. A rigid track as in claim 14, wherein said structural metal member prestresses said curb along a longitudinal axis.

17. A rigid track bed for a track guided vehicle, the rigid track comprising:

at least one precast concrete slab;

rails disposed on said precast concrete slab, said rails configured to accommodate the track guided vehicle;

at least one rail fastening disposed on said precast concrete slab, said fastening securing said rails to said precast concrete slab;

a curb operably carried on said precast concrete slab and aligned parallel to at least one side of at least one of said rails, said curb configured to provide protection and guidance to the track guided vehicle upon derailment of the track guided vehicle; and wherein said curb includes a structural metal member and defines at least one slot extending transverse to a longitudinal axis of said precast concrete slab and said structural metal member is interrupted at said at least one slot.

18. A rigid track bed for a track guided vehicle, the rigid track comprising:

at least one precast concrete slab;

rails disposed on said precast concrete slab, said rails configured to accommodate the track guided vehicle;

at least one rail fastening disposed on said precast concrete slab, said fastening securing said rails to said precast concrete slab;

a curb operably carried on said precast concrete slab and aligned parallel to at least one side of at least one of said rails, said curb configured to provide protection and guidance to the track guided vehicle upon derailment of the track guided vehicle;

wherein said at least one rail fastening is at least one of a continuous fastening or a multiplicity of fastenings; and wherein a bottom of said curb extends above said at least one rail fastening proximal to said at least one rail fastening.

19. A rigid track as in claim 18, wherein said at least one rail fastening is installed at elevated support points on said precast concrete slab.

20. A rigid track as in claim 18, wherein said curb is integral to said precast concrete slab.

21. A rigid track as in claim 18, wherein a longitudinal side of said curb proximal to said at least one of said rails has a separating distance from a top of said rail that corresponds to space that allows acceptance of a derailed wheel of the track guided vehicle.

22. A rigid track as in claim 18, wherein said curb includes a structural metal member.

23. A rigid track as in claim 22, wherein said structural metal member comprises an angle bar disposed along a longitudinal side of said curb proximal to said at least one of said rails.

* * * * *